US006634737B2

(12) United States Patent
Sugioka

(10) Patent No.: US 6,634,737 B2
(45) Date of Patent: Oct. 21, 2003

(54) INK JET RECORDING HEAD AND INK JET RECORDING APPARATUS

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/918,458

(22) Filed: Aug. 1, 2001

(65) Prior Publication Data

US 2002/0021333 A1 Feb. 21, 2002

(30) Foreign Application Priority Data

Aug. 4, 2000 (JP) ..... 2000-236890

(51) Int. Cl.[7] ..... B41J 2/05

(52) U.S. Cl. ..... 347/58; 347/61

(58) Field of Search ..... 347/56, 58, 61

(56) References Cited

FOREIGN PATENT DOCUMENTS

| | | |
|---|---|---|
| EP | 0 394 699 A | 10/1990 |
| EP | 0 995 600 A2 | 4/2000 |
| JP | 57-36679 | 2/1982 |
| JP | 62-201254 | 9/1987 |
| JP | 64-20150 | 1/1989 |
| JP | 64-20151 | 1/1989 |
| JP | 64-20152 | 1/1989 |
| JP | 08-15629 | 1/1996 |

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides an ink jet recording head comprising a heat generating device for generating thermal energy utilized to discharge ink, a non-linear element having a non-linear current/voltage property and adapted to drive the heat generating means, and a current adjusting device for adjusting current flowing into the non-linear element.

19 Claims, 9 Drawing Sheets

MIM TYPE ELECTRICAL CHARACTERISTICS

INK JET RECORDING HEAD AND INK JET RECORDING APPARATUS

BACKGROUND OF THE INVENTION

1. Field of the Invention

The present invention relates to an ink jet recording head applied to an ink jet printer particularly a bubble jet printer utilizing an bubbling phenomenon, and an ink jet recording apparatus having such an ink jet recording head.

2. Related Background Art

A recording head applied to a bubble jet recording system generally includes minute discharge ports, flow paths, and heat generating members provided in the flow paths.

The bubble jet recording system means a recording system in which a bubble is generated in liquid due to film-building caused locally increasing the liquid in the flow path by utilizing the heat generating member and the liquid is discharged from the minute discharge port by utilizing high pressure of the bubble, thereby adhering the liquid onto a recording paper and the like.

In order to obtain high quality of an image recorded by such a recording technique, a minute liquid droplets must be discharged with high density. To this end, it is fundamentally important to form minute flow paths and minute heat generating sources. Thus, in the bubble jet recording system, by making use of simplicity of the structure, there has been proposed a method for manufacturing a high density head by utilizing a photolithography technique (For example, refer to Japanese Patent Application Laid-Open No. 08-15629). Further, in order to adjust a discharge amount of liquid droplets, a heat generating member including a central portion having a heat generating amount greater than those in end portions (Refer to Japanese Patent Application Laid-Open No. 62-201254). As the heat generating member, generally, a thin film resistance body made of tantalum nitride is used, and the liquid is bubbled by Joule heat generated by energizing the heat generating member. In such a heat generating member, in order to prevent damage of a surface of the heat generating resistance body due to cavitation, generally, an anti-cavitation layer having a thickness of about 0.2 $\mu$m and made of metal such as Ta is provided on the surface via an insulator having a thickness of about 0.8 $\mu$m and made of SiN.

Further, Japanese Patent Application Laid-Open No. 64-20150 discloses a multi nozzle ink jet head characterized in that a plurality of vertical and lateral wirings are provided on a substrate, and rectifying elements permitting flow of only normal electric current and heat generating elements connected to the rectifying elements are provided at junctions between the vertical wirings and the lateral wirings. Further, Japanese Patent Application Laid-Open No. 57-36679 discloses a thermal head in which diodes capable of generating heat by energization in normal direction are arranged as plural arrays.

In conventional multi nozzle heads, when the heat generating elements connected to the junctions between the vertical wirings and the lateral wirings are selectively driven in a matrix fashion, noise voltage smaller than drive voltage may be added to non-selected heat generating elements to generate undesirable heat. The Inventors found that the heat generating element may have directly or indirectly a current/voltage property indicating a low resistance value at a high voltage side and a high resistance value at a low voltage side in order to prevent generation of heat if the noise voltage is applied to the non-selected heat generating element. As elements having such a current/voltage property, there are a MIM element and a barister.

Further, in many conventional heads, it is assumed that the heat generating elements diodes and logic circuits are simultaneously formed on a silicon substrate by a semiconductor process (such as ion injecting method). Accordingly, a head having relatively few nozzles can be made relatively compact and cam be formed by a single process. However, for example, in a full multi head having a length corresponding to entire width of a recording paper, if the head is manufactured as a single piece, a length of 12 inches is required, and, thus, it is difficult to use a normal silicon wafer, which may make a manufacturing method expensive.

If ink jet heat generating elements having non-linear elements such as MIM elements which can be manufactured without using a conventional semiconductor process such as the ion injecting method can be driven in the matrix fashion, there is the possibility that an elongated ink jet head can be provided at a low cost.

However, since MIM element has a non-linear property in the current/voltage property that the current value is changed sensitively depending upon the voltage value, if drive voltage of a power source is changed slightly, the current flowing through the MIM element is changed greatly, with the result that the heat generating element (heater) as a bubble generating portion may be heated excessively to damage the heater or poor discharging may occur due to insufficient heating. Thus, adjustment of the drive voltage of the power source becomes very severe.

SUMMARY OF THE INVENTION

An object of the present invention is to provide an ink jet recording head which utilizes an MIM element capable of realizing an elongated ink jet head with a low cost and which can prevent excessive heating and poor heating of a BJ heater by suppressing great fluctuation of an electric power supplying amount of the MIM element due to minute change in the drive voltage of a power source, and an ink jet recording apparatus having such an ink jet recording head.

To achieve the above object, according to a first aspect of the present invention, there is provided an ink jet recording head comprising heat generating means for generating thermal energy utilized to discharge ink, a non-linear element having a non-linear current/voltage property and adapted to drive the heat generating means, and current adjusting means for adjusting current flowing into the non-linear element.

In this case, the current adjusting means may be a current adjusting resistor connected to the non-linear element in series. The current adjusting resistor is preferably constituted by a heat generating resistance body, a wiring resistor or an adjusting resistor. Further, a resistance value of the current adjusting resistor is from 0.1 to 10 times, preferably, about 1 time or 2 times, of a resistance value of the non-linear element in an operating condition. The non-linear element used in such a recording head is preferably a non-linear element indicating MIM type electrical characteristics.

In the above-mentioned ink jet recording head, the heat generating means may also act as the non-linear element or the heat generating means may be formed independently from the non-linear element.

Further, according to a second aspect of the present invention, there is provided an ink jet recording head comprising heat generating means including a heat generating resistance member for generating thermal energy utilized to discharge ink and a pair of electrodes connected to the heat generating resistance member, and a non-linear element connected to the heat generating resistance member in series, and wherein the heat generating resistance member is used as a current adjusting resistor for adjusting electrical current flowing in a circuit in which the non-linear element is connected to the heat generating resistance member in series.

In this case, a resistance value of the heat generating resistance member is from 0.1 to 10 times, preferably, about 1 time or about 2 times, of a resistance value of the non-linear element in an operating condition. Particularly when the non-linear element is a non-linear element indicating the MIM type electrical characteristics, an ink jet recording head wherein a two-terminal circuit unit in which the non-linear element is connected to the heat generating resistance member in series is disposed at a junction of a matrix circuit and wiring resistance of the two-terminal circuit unit is substantially zero and the resistance value of the heat generating resistance member is about 1 time of the resistance value of the non-linear element and matrix driving of ½ bias system is effected on the matrix circuit, or an ink jet recording head wherein a two-terminal circuit unit in which the non-linear element is connected to the heat generating resistance member in series is disposed at a junction of a matrix circuit and wiring resistance of the two-terminal circuit unit is substantially zero and the resistance value of the heat generating resistance member is about 2 times of the resistance value of the non-linear element and matrix driving of ⅓ bias system is effected on the matrix circuit is preferable.

Further, according to a third aspect of the present invention, there is provided an ink jet recording head comprising heat generating means for generating thermal energy utilized to discharge ink, a non-linear element for driving the heat generating means, and a wiring for energizing the non-linear element, and wherein resistance of the wiring is used as a current adjusting resistor for adjusting current flowing in a circuit including the non-linear element and the wiring.

In this case, a resistance value of the wiring resistor is from 0.1 to 10 times, preferably, about 1 times or about 2 times, of a resistance value of the non-linear element in an operating condition, and the non-linear element is preferably a non-linear element indicating the MIM type electrical characteristics.

Further, according to a fourth aspect of the present invention, there is provided an ink jet recording head comprising heat generating means for generating thermal energy utilized to discharge ink, a non-linear element having a non-linear current/voltage property and adapted to drive the heat generating means, and matrix electrodes constituting a matrix circuit for applying voltage to the heat generating means, and wherein the non-linear element is disposed at a junction of the matrix circuit and the current/voltage property at the junction has differential resistance of 40 to 250 Ω at drive voltage of the heat generating means. In this case, the heat generating means is a heat generating resistance member, and a two-terminal circuit unit in which the non-linear element is connected to the heat generating resistance member in series is disposed at the junction of the matrix circuit.

Further, according to a fifth aspect of the present invention, there is provided an ink jet recording head comprising heat generating means for generating thermal energy utilized to discharge ink, a non-linear element having a non-linear current/voltage property and adapted to drive the heat generating means, and matrix electrodes constituting a matrix circuit for applying voltage to the heat generating means, and wherein the non-linear element is disposed at a junction of the matrix circuit and the current/voltage property at the junction is such that effective current starts to flow the junction from voltage of about ½ time of operating voltage and desired current flows at the operating voltage. In this case, the heat generating means is a heat generating resistance member, and a two-terminal circuit unit in which the non-linear element is connected to the heat generating resistance member in series is disposed at the junction of the matrix circuit.

Further, according to a sixth aspect of the present invention, there is provided an ink jet recording head comprising heat generating means for generating thermal energy utilized to discharge ink, a non-linear element having a non-linear current/voltage property and adapted to drive the heat generating means, and matrix electrodes constituting a matrix circuit for applying voltage to the heat generating means, and wherein the non-linear element is disposed at a junction of the matrix circuit and the current/voltage property at the junction is such that effective current starts to flow the junction from voltage of about ⅓ time of operating voltage and desired current flows at the operating voltage. In this case, the heat generating means is a heat generating resistance member, and a two-terminal circuit unit in which the non-linear element is connected to the heat generating resistance member in series is disposed at the junction of the matrix circuit.

Further, in the recording head according to the present invention, preferably, there is provided matrix electrodes constituting a matrix circuit for applying voltage to the heat generating means, and, in this case, the non-linear element is preferably disposed at a junction of the matrix circuit. In the recording heads according to the first to third aspects, preferably, the ink is discharged by causing film-boiling in the ink by the thermal energy.

Further, an ink jet recording apparatus according to the present invention is characterized by an ink jet recording head according to the above first, second or third aspect in which an ink discharge port is disposed a confronting relationship to a recording surface of a recording medium, and conveying means for conveying the recording medium.

Further, an ink jet recording apparatus according to the present invention is characterized in that it comprises an ink jet recording head comprising heat generating means including a heat generating resistance member for generating thermal energy utilized to discharge ink and a pair of electrodes connected to the heat generating resistance member, and a non-linear element connected to the heat generating resistance member in series and indicating MIM type electrical characteristics and in which the heat generating resistance member is used as a current adjusting resistor for adjusting current flowing in a circuit in which the non-linear element is connected to the heat generating resistance member in series, and conveying means for conveying a recording medium, and wherein a resistance value of the heat generating member is from 0.1 to 10 times, preferably, about 1 time or about 2 times, of a resistance value of the non-linear element in an operating condition.

In this case, an ink jet recording apparatus in which a two-terminal circuit unit in which the non-linear element is connected to the heat generating resistance member in series is disposed at a junction of a matrix circuit and wiring resistance of the two-terminal circuit unit is substantially zero and the resistance value of the heat generating resistance member is about 1 time of the resistance value of the non-linear element and matrix driving of ½ bias system is effected on the matrix circuit, or an ink jet recording apparatus in which a two-terminal circuit unit in which the non-linear element is connected to the heat generating resistance member in series is disposed at a junction of a matrix circuit and wiring resistance of the two-terminal circuit unit is substantially zero and the resistance value of the heat generating resistance member is about 2 times of the resistance value of the non-linear element and matrix driving of ⅓ bias system is effected on the matrix circuit is preferable.

With the arrangement as mentioned above, by providing the non-linear element (particularly, non-linear element having the MIM type electrical characteristics) and the current adjusting means for adjusting the current flowing in the non-linear element in series, particularly, heat generating resistance member or wiring resistor) in a heat driving circuit for effecting ink jet discharging, change in current flowing in the circuit is suppressed, thereby suppressing great change in an electrical power supplying amount of the MIM element due to minute change in voltage of the discharge driving power source. Thus, excessive heating or poor heating of the ink jet heater can be prevented. Further, since the ink jet heater can be effectively driven in the matrix fashion by using the non-linear element which can be manufactured without using the conventional semiconductor process such as an ion injecting method, an inexpensive elongated ink jet head can be provided.

DETAILED DESCRIPTION OF THE PREFERRED EMBODIMENTS

The present invention will now be explained in connection with embodiments thereof with reference to the accompanying drawings.

Figure 1:
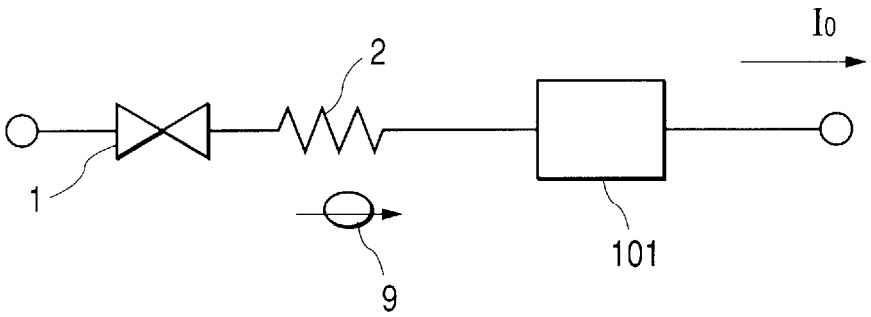
FIG. 1 is a conceptional view showing characteristics of an ink jet recording head according to the present invention.

FIG. 1 is a conceptional view showing characteristics of an ink jet recording head according to the present invention. In FIG. 1, an ink jet recording head comprises an MIM (metal insulator metal) element 1 as an non-linear element, a heat generating resistance member 2 for heating discharge liquid and for discharging discharge liquid droplet, and a current adjusting circuit 101 as current adjusting means for adjusting current flowing in the MIM element. Incidentally, the reference numeral denotes generation of the discharge liquid droplet conceptionally.

In this embodiment, by providing the MIM element 1 and the current adjusting circuit 101 for adjusting the current flowing in the MIM element 1, since change in current flowing in a driving circuit for heating the discharge liquid can be suppressed to suppress great change in an electrical power supplying amount of the MIM element 1 due to minute change in voltage of the power source, excessive heating or poor heating of the heat generating resistance member 2 as an ink jet heater.

Figure 2:
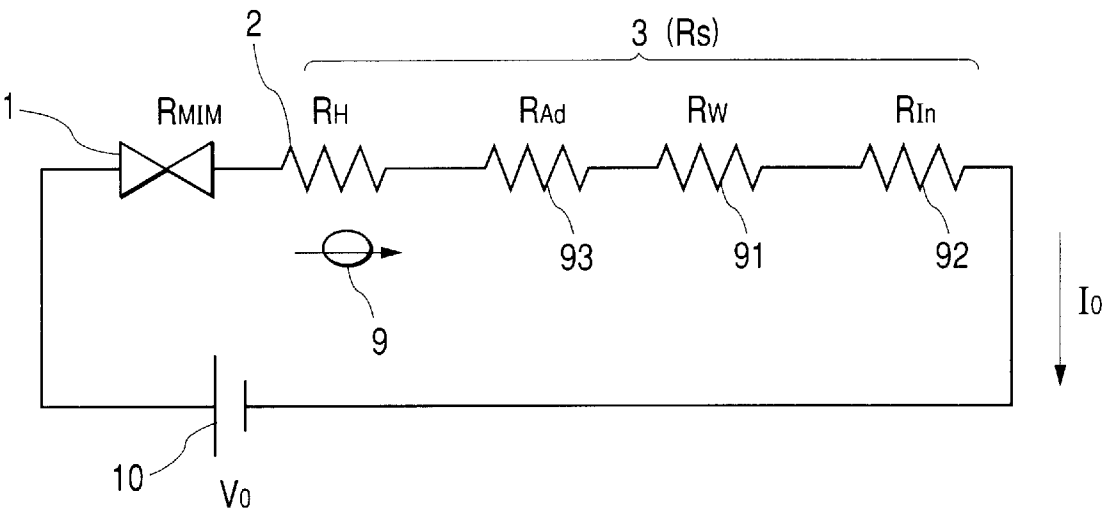
FIG. 2 is a view showing further concrete characteristics.

FIG. 2 is a view showing further concrete characteristics of the embodiment shown in FIG. 1. More specifically, the current adjusting means 101 is a current adjusting resistance including the heat generating resistance member 2 connected to the MIM element 1 in series. Since the current adjusting resistor can be manufactured relatively easily, the cost for manufacturing the head can be reduced. Particularly, the current adjusting resistor ($R_S$) is constituted by the heat generating resistance member ($R_H$) 2 or a wiring resistor ($R_W$) 91 or an internal resistor ($R_I$) 92 of the power source or an adjusting resistor ($R_{Ad}$) 93, which is connected to an MIM element 1 in series. Since the heat generating resistance member 2, wiring resistor 91 and internal resistor 92 of the power source are elements indispensable for the ink jet recording head for discharging ink by utilizing thermal energy generated by the heat generating resistance member 2, it is cost effective when required current adjustment can be achieved by using these element. Incidentally, in FIG. 2, for convenience, an arrangement including all of these resistors 2, 91, 92, 93 is shown. Further, in FIG. 2, the reference numeral 10 denotes a power source having voltage $V_0$, and $I_0$ denotes a current value flowing in the circuit. However, since the internal resistor of the power source is very small in comparison with the resistance value of the MIM element in an operating condition and other resistance values, it is substantially negligible.

Figure 3:
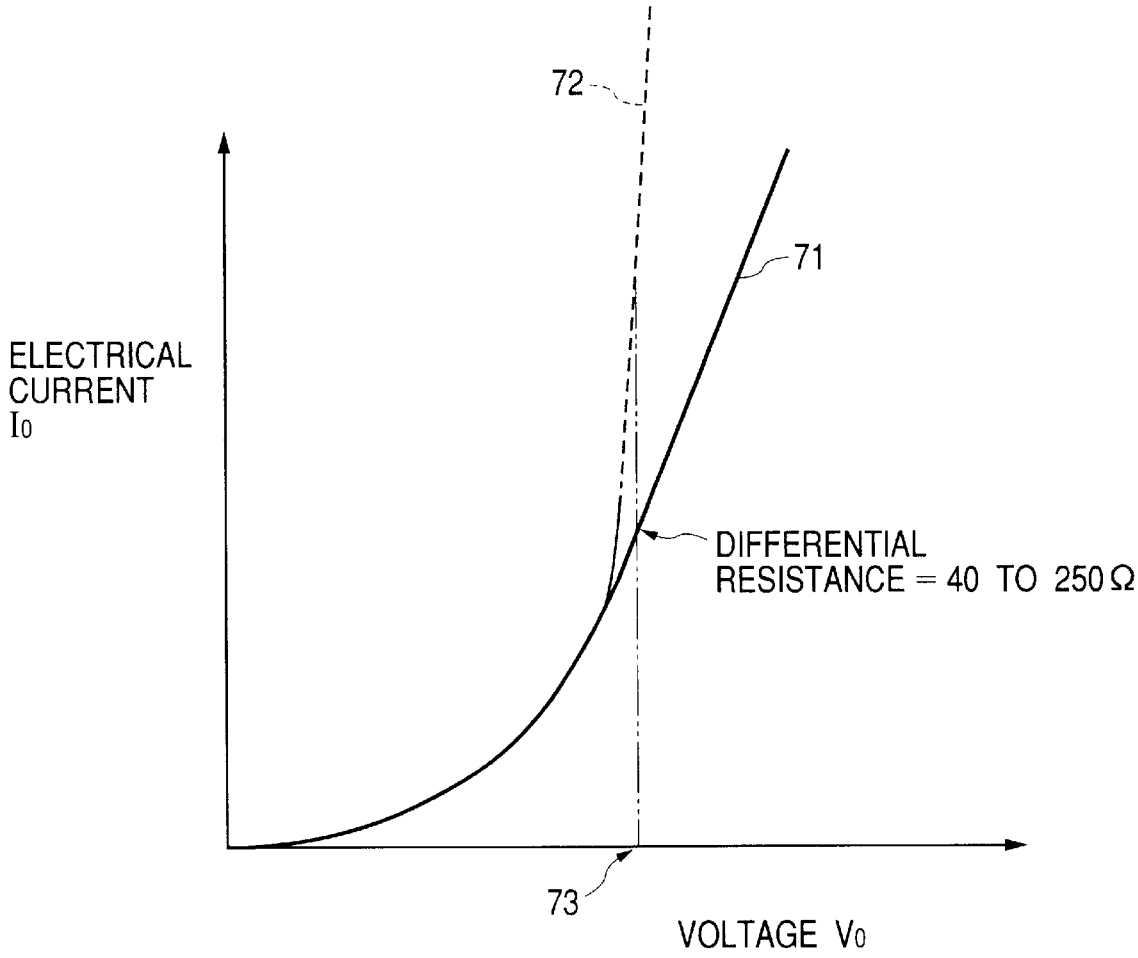
FIG. 3 is a graph for showing a relationship between a current value $I_0$ flowing in a circuit shown in FIG. 2 and a voltage value $V_0$ of a power source and for explaining a current adjusting resistance effect.

FIG. 3 is a view showing a relationship between a current value $I_0$ flowing the circuit and the voltage value $V_0$ of the power source 10. Further, the broken line 72 indicates a current/voltage property when an appropriate resistor is not connected to the MIM element 1, and the solid line 71 indicates a current/voltage property stably when an appropriate current adjusting resistor is connected to the MIM element 1 in series. In the property shown by the broken line 72 indicating the fact that an appropriate resistor is not connected to the MIM element 1, circuit current is considerably changed by change in voltage of the power source in the vicinity of operating voltage 73 (shown by the dot and chain line in FIG. 3), with the result that excessive heating or poor heating of the heat generating resistance member 2 is apt to occur. On the other hand, in the property shown by the solid line 71 indicating the fact that an appropriate current adjusting resistor is connected to the MIM element 1 in series, the circuit current is gently changed by change in voltage of the power source in the vicinity of the operating voltage 73 (shown by the dot and chain line in FIG. 3), with the result that the excessive heating or poor heating of the heat generating resistance member 2 can be prevented.

Further, in the ink jet recording head, since excessive heating or poor heating caused when discharging voltage is applied arises a problem, the value $R_S$ of the current adjusting resistor 3 must be set on the basis of a resistance value in an ON operating condition when the discharging voltage is applied.

Further, if the value of the current adjusting resistor 3 is too low, non-linearity becomes too preferential to lose a function for limiting circuit current, thereby causing the excessive heating or poor heating. Thus, it is desirable that a lower limit of the resistance value of the current adjusting resistor 3 is about 0.1 time of the resistance value of the MIM element 1 in the operating condition.

On the other hand, if the value of the current adjusting resistor 3 is too high, linearity becomes too preferential to lose the advantage of the MIM element 1, with the result that a normal discharging operation under the matrix driving may become difficult. Thus, it is desirable that an upper limit of the resistance value of the current adjusting resistor 3 is about 10 times of the resistance value of the MIM element 1 in the operating condition.

Further, from the above explanation, it is preferable that the linearity and non-linearity are provided half and half, and, to this end, it is preferable that the resistance value of the current adjusting resistor 3 is equal to the resistance value of the MIM element 1 in the operating condition.

Figure 8:
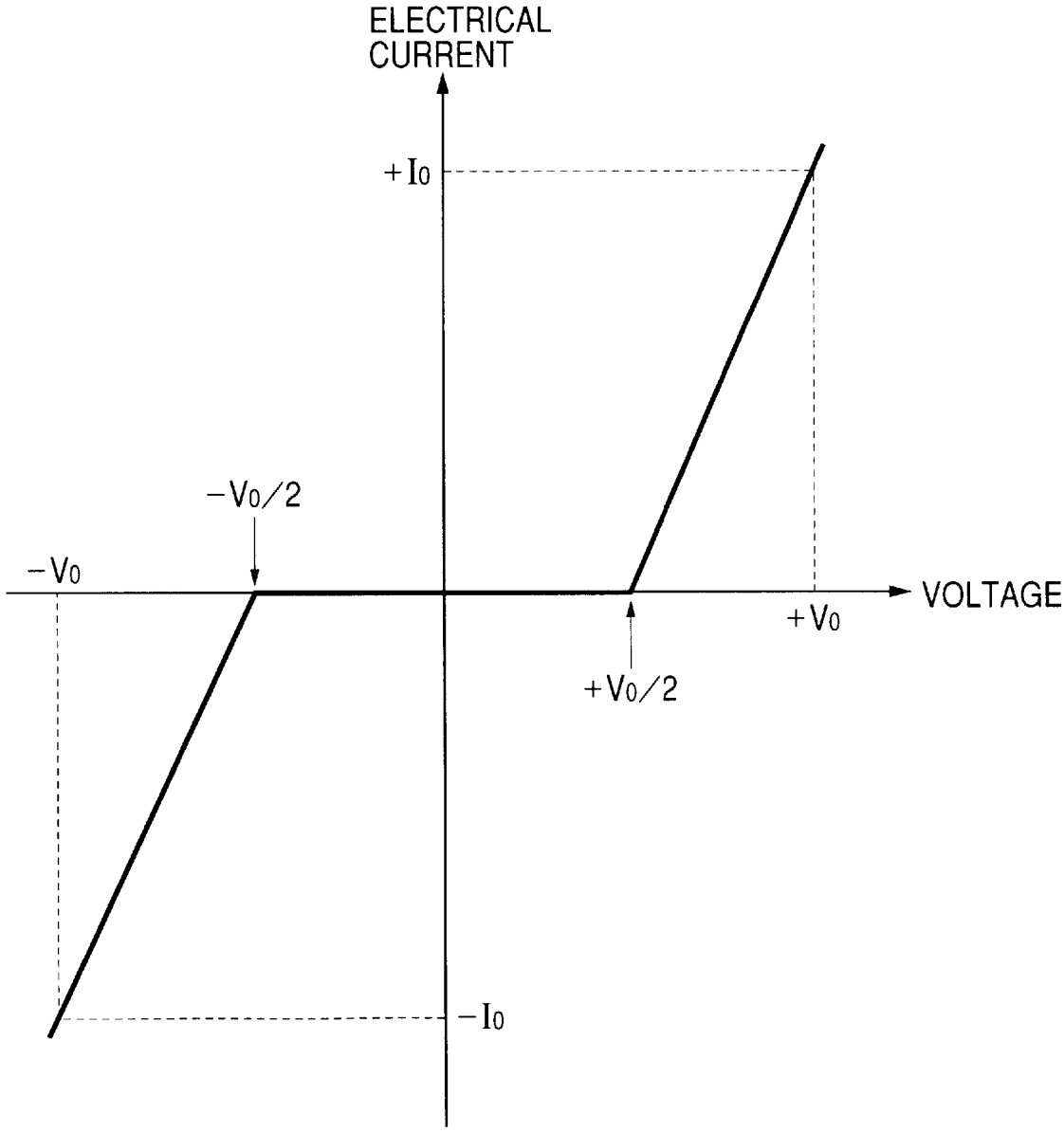
FIG. 8 is a view for explaining an ideal condition of a current/voltage property of a two-terminal circuit unit according to the second embodiment of the present invention.

Particularly, when a two-terminal circuit unit 12 in which the MIM element 1 is connected to the heat generating resistance member 2 in series is disposed at a junction of the matrix circuit and matrix driving is effected in a ½ bias system, it is preferable that the wiring resistance is set to zero as less as possible and the resistance value of the heat generating resistance member is set to about 1 time of the resistance value of the MIM element 1. In this case, as schematically shown in FIG. 8, a current/voltage property of the two-terminal circuit unit 12 becomes such that ON current of $I_0$ flows with respect to selected voltage $V_0$ giving an ON condition to the two-terminal circuit unit 12 and current does not flow with respect to non-selected voltage of $\pm V_0/2$. That is to say, the current/voltage property of the two-terminal circuit unit 12 is such that effective current starts to flow in the two-terminal circuit unit 12 from voltage of about ½ time of the operating voltage and desired current flows in the two-terminal circuit unit 12 at the operating voltage. In the matrix driving in the ½ bias system, when the current/voltage property of the two-terminal circuit unit shows the property illustrated in FIG. 8, an ideal condition that power loss of the MIM element becomes minimum.

Figure 9:
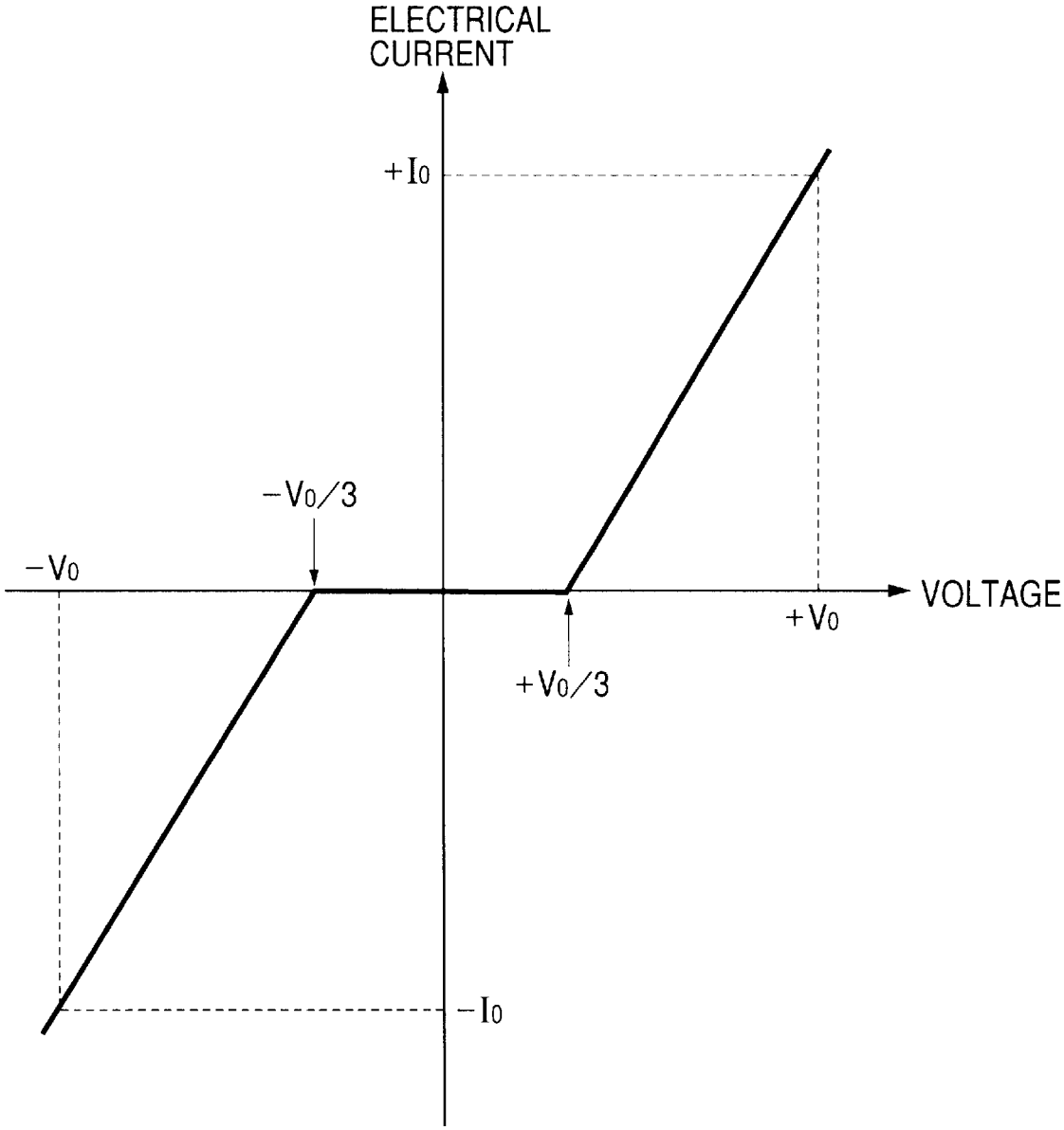
FIG. 9 is a view for explaining another ideal condition of a current/voltage property of a two-terminal circuit unit according to the second embodiment of the present invention.

Further, similarly, when the two-terminal circuit unit 12 in which the MIM element 1 is connected to the heat generating resistance member 2 in series is disposed at the junction of the matrix circuit and matrix driving is effected in a ⅓ bias system, it is preferable that the wiring resistance is set to zero as less as possible and the resistance value of the heat generating resistance member is set to about 2 times of the resistance value of the MIM element 1. In this case, as schematically shown in FIG. 9, the current/voltage property of the two-terminal circuit unit 12 becomes such that ON current of $I_0$ flows with respect to selected voltage $V_0$ giving the ON condition to the two-terminal circuit unit 12 and current does not flow with respect to non-selected voltage of $\pm V_0/3$. That is to say, the current/voltage property of the two-terminal circuit unit 12 is such that effective current starts to flow in the two-terminal circuit unit 12 from voltage of about ⅓ times of the operating voltage and desired current flows in the two-terminal circuit unit 12 at the operating voltage. In the matrix driving in the ⅓ bias system, when the current/voltage property of the two-terminal circuit unit shows the property illustrated in FIG. 9, an ideal condition that power loss of the MIM element becomes minimum.

Further, checking the current/voltage property from a different viewpoint, as shown in FIG. 3, differential resistance of the two-terminal circuit unit may be 40 to 250 Ω. As result, the value of the current adjusting resistor 3 can be made optimum.

In this embodiment, in consideration of the above required factors, particularly, the resistance value of the current adjusting resistor 3 is selected from 0.1 to 10 times, and more preferably, about 1 time or about 2 times, of the resistance value of the MIM element 1 in the operating condition. By selecting the resistance value of the current adjusting resistor 3 in this way, the non-linearity in the vicinity of the ON operating voltage can be suppressed to prevent excessive heating or poor heating of the heat generating resistance member 2 as the ink jet heater.

Next, embodiments of the present invention will be described by using a concrete construction and numerical values. Further, in the following explanation, the same constructural elements as those shown in FIGS. 1 and 2 are designated by the same reference numerals.

[First Embodiment]

Figure 4:
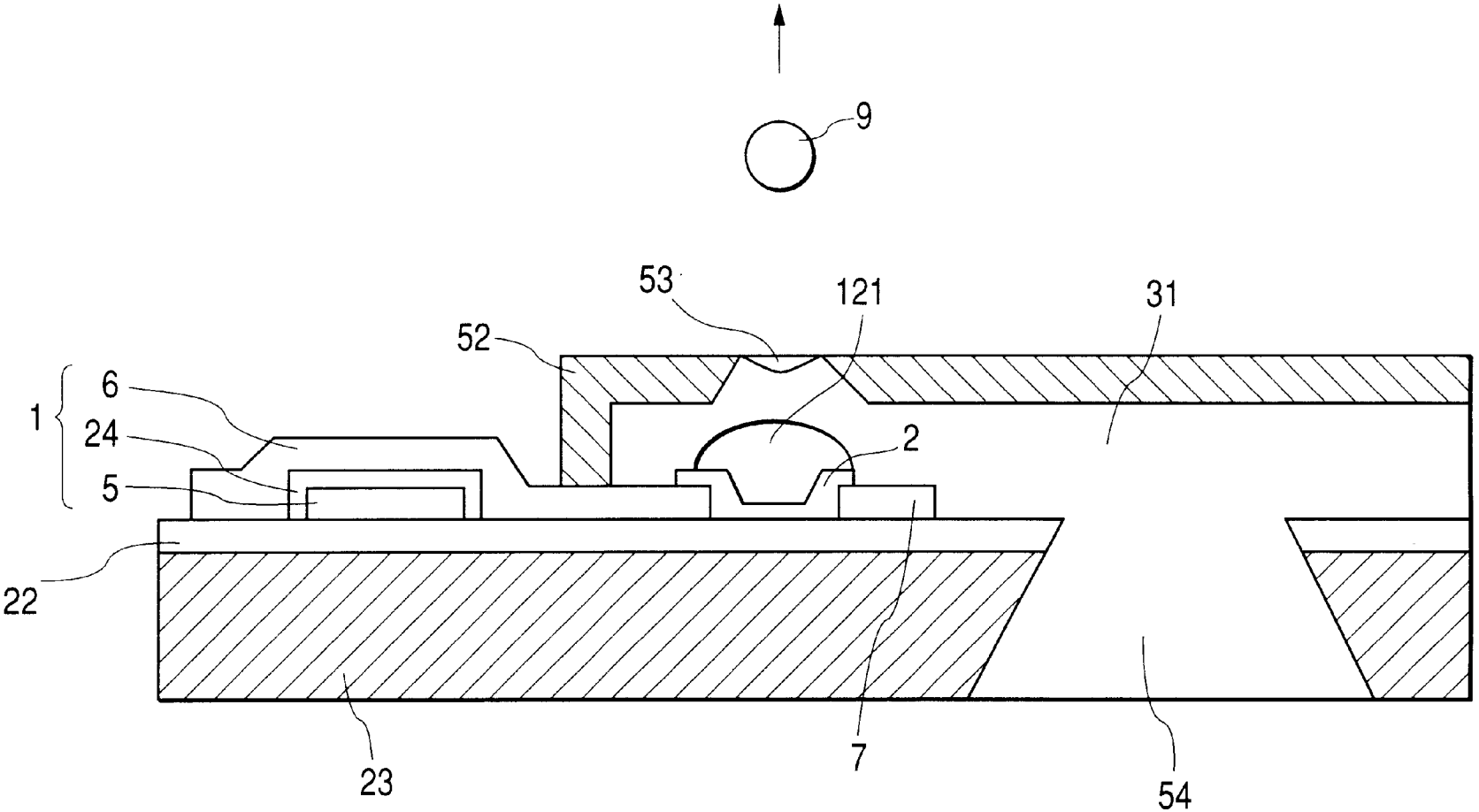
FIG. 4 is a schematic sectional view of an ink jet recording head according to a first embodiment of the present invention.

FIG. 4 is a schematic sectional view of an ink jet recording head according to a first embodiment of the present invention. Referring to FIG. 4, a head according to the first embodiment includes a substrate 23 having a lower layer (insulation layer) 22 as a surface. On the lower layer (insulation layer) 22, a lower electrode 5 for constituting the MIM element 1 and acting also as a scan side electrode constituting the matrix circuit is coated by a very thin insulation film 24. Further, an upper electrode 6 constituting the MIM element 1 is coated on the insulation thin film 24. The upper electrode 6 is connected to one end of a thin film heat generating resistance member 2 formed on the lower layer (insulation layer) 22 and spaced apart from the lower electrode 5. The other end of the thin film heat generating resistance member 2 is connected to an information side electrode 7 constituting the matrix circuit.

Further, a discharge port forming member 52 having plural rows of grooves for forming flow paths 31 including one or plural thin film heat generating resistance members 2 and discharge ports 53 (for discharging recording liquid) corresponding to the flow paths 31 is joined onto the substrate 23. Further, the substrate 23 is provided with a discharge liquid supplying port 54 for simultaneously supplying the liquid to the plural flow paths 31.

Incidentally, in the illustrated embodiment, while an example that a head structure of so-called side shooter type in which the discharge ports 53 are arranged in perpendicular to a heat generating member forming plane at the discharge port forming member 52 is used was explained, the present invention can be applied to a so-called edge shooter type in which the discharge ports are arranged along a direction parallel to the heat generating member forming plane.

As shown in FIG. 4, the construction according to the illustrated embodiment includes MIM elements 1 disposed at junction of the matrix circuit, and the heat generating resistance members 2 connected to the MIM elements 1 in series, and the heat generating resistance member 2 is used as the current adjusting resistor, and by selecting the resistance value of the heat generating resistance member 2 from 0.1 to 10 times, preferably, about 1 time or 2 times of the resistance value of the MIM element 1 in the operating condition, change in current flowing in the circuit can be suppressed. Since the great change in the electrical power supplying amount of the MIM element 1 due to minute change in voltage of the power source can be suppressed, the excessive heating or poor heating of the heat generating resistance member 2 as the ink jet heater can be prevented.

Further, in FIG. 4, by applying liquid droplet discharging voltage between the scan side electrode 5 and the information side electrode 7 which constitute the matrix circuit, the electrical power is supplied to the thin film heat generating member 2 in the ON condition of the MIM element 1, thereby heating the discharge liquid quickly. In this way, a bubble 121 is generated to discharge liquid droplet 9 toward a recording medium, thereby forming an image.

Figure 5:
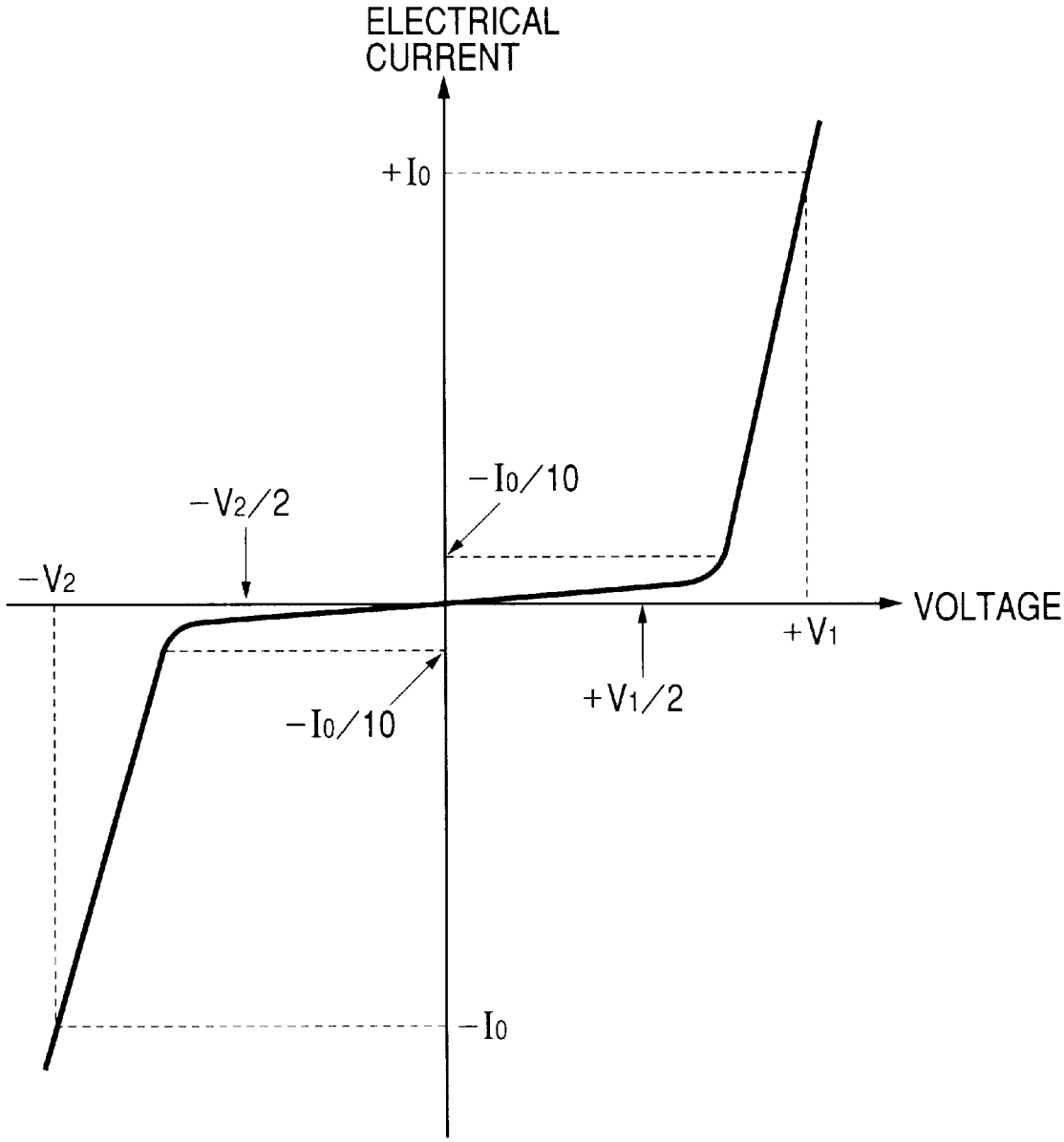
FIG. 5 is a graph for explaining MIM type electrical characteristics in the present invention.

FIG. 5 is a view showing the MIM type electrical characteristics. The MIM type electrical characteristics are current/voltage property in which a low resistance value is obtained at a high voltage side and a high resistance value is obtained at a low voltage side regardless of polarity, such as current/voltage property represented by an MIM element or a barister. The non-linear element applied to the present invention is particularly a non-linear element having the MIM type electrical characteristics.

Here, as shown in FIG. 5, to effect the matrix driving, it is preferable that applied voltage giving the absolute value $I_0$ of the current value is $+V_1$, and $V_2$ satisfies a relationship $0.5<(V_1/V_2)<2$, and the absolute value of the current value at $+V_1/2$ and $-V_2/2$ is smaller than $I_0/10$. By arranging the non-linear elements having the MIM type electrical characteristics at the junctions of the matrix electrodes, undesirable heating at the non-selected points due to bias voltage in the matrix driving can be suppressed, thereby performing the matrix driving of the ink jet heaters effectively. Further, by utilizing the matrix driving, separation between the driver and the heater can be facilitated, and mass production on a cheap non Si substrate can be permitted.

Further, the illustrated embodiment relates to an ink jet recording head in which the MIM element having a structure "metal/insulator/metal" including of very thin oxidation insulation film connected between electrodes are used as non-linear elements.

Here, the MIM element fundamentally means a tunnel coupling element having a structure "metal/insulator/metal". However, normally, a coupling element having a structure "conductive electrode/insulator/conductive electrode" is also referred to as a MIM element. Here, as a conduction mechanism of insulator, hopping type electrical conduction such as Pool-Frenkel type conduction in which plural tunnelings are repeated in insulator and relatively simple tunnel conduction such as Fauler-Noldheim type conduction are known. In order to flow such tunnel type current and to flow current in the coupling element, a distance between the electrodes must be very small.

Although limit film thickness or limit electrode-to-electrode distance of insulator permitting flow of current in the MIM element greatly depends upon insulation material, electrode material and conduction mechanism, in order to flow effective current in the MIM element, for example, it is desirable that the distance between the electrodes is selected to 100 nm or less. Further, if the distance between the electrodes is too small, since ions on the metal surfaces of the electrodes may cause field radiation, it is desirable that the distance between the electrodes is selected to 1 nm or more. Further, it is desirable that the distance between the electrodes is selected to 4 nm or more in order to obtain stable tunnel coupling. Further, in order to obtain great current required for the matrix driving of the bubble jet recording head with low voltage, preferably, it is desirable that the distance between the electrodes is selected to 40 nm or less. Accordingly, by using the MIM element in which the distance between the electrodes is greater than 1 nm and smaller than 100 nm and preferably greater than 4 nm and smaller than 40 nm as heat generating means, the bubble can be generated by heating the liquid by means of the MIM element to discharge the liquid droplet (refer to Second Embodiment in detail).

Further, so-called barister in which a sintering layer obtained by adding metal oxide such as Pr and co to ZnO or a grain crystal layer of SiC of silicon carbide group is disposed between the electrodes in place of the insulation layer can also be used as the non-linear element similar to the MIM element, thereby achieving the similar effect.

Figure 6:
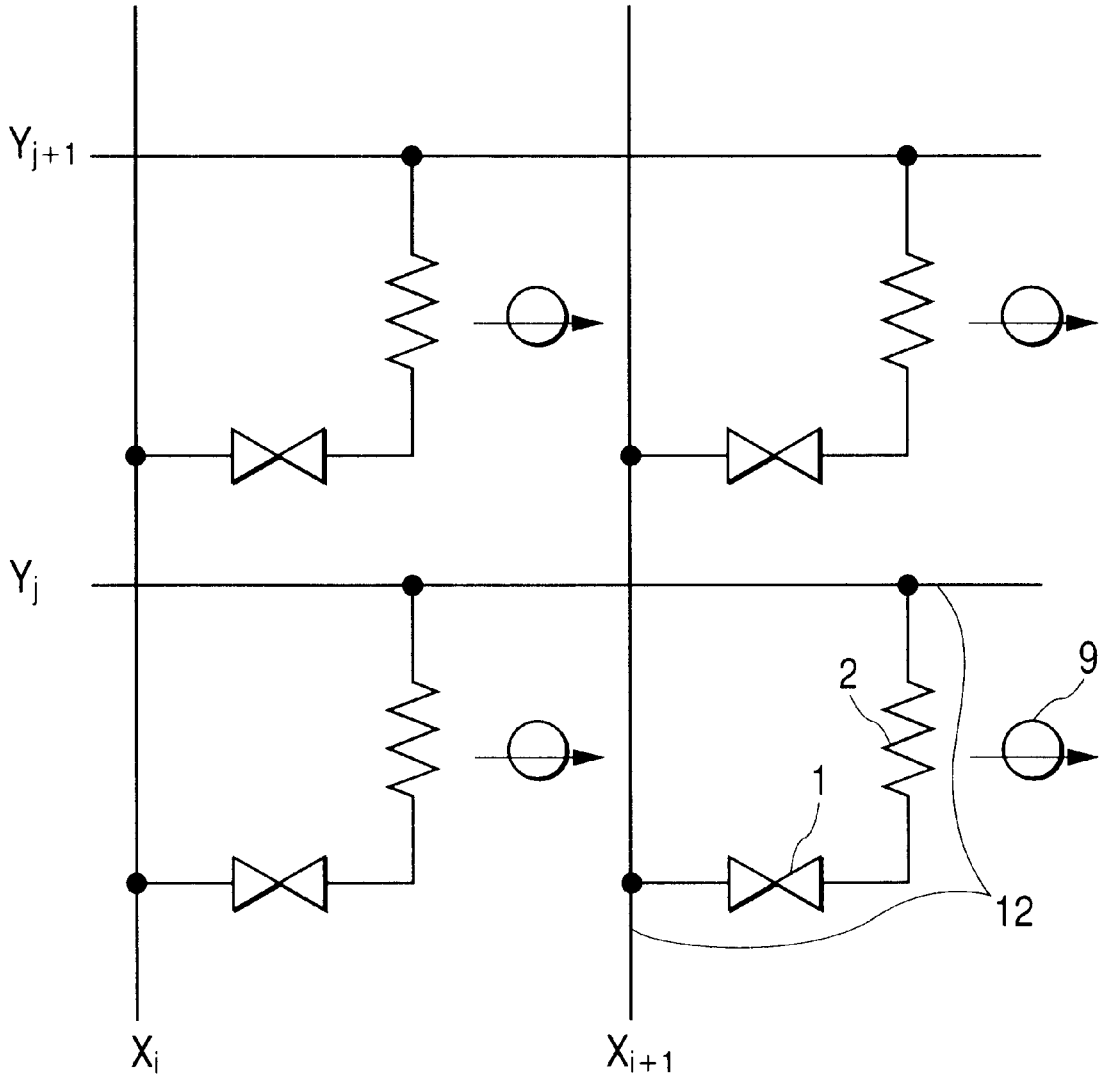
FIG. 6 is a view for explaining a matrix circuit according to a first embodiment of the present invention.

FIG. 6 is a conceptional view showing characteristic of the matrix circuit constituting the head according to the illustrated embodiment. In FIG. 6, wirings, $Y_j$, $Y_{j+1}$, are j-th and (j+1)-th scan side electrodes, and wirings $X_i$, $X_{i+1}$, are i-th nd (i+1)-th information side electrodes. That is to say, the wirings $Y_j$, $Y_{j+1}$, $X_i$, $X_{i+1}$, constitute the matrix circuit. Further, the reference numeral 1 denotes the MIM element disposed at the junction of the matrix; 2 denotes the heat generating resistance member; and 9 denotes the discharge liquid.

As shown in FIG. 6, in the illustrated embodiment, the heat includes the matrix circuit composed of the wiring electrodes $Y_j$, . . . $Y_{j+1}$, . . . and the wiring electrodes $X_i$, $X_{i+1}$, . . . , the MIM elements 1 as the non-linear elements disposed at the junctions of the matrix circuit, and the heat generating resistance members 2 connected to the MIM elements 1 in series.

In FIG. 6, by inputting selection potential wave form to one of the scan side electrodes $Y_j$, $Y_{j+1}$, . . . and by inputting discharge or non-discharge information potential wave forms to the information side electrodes $X_i$, $X_{j+1}$, . . . in accordance with the image signal, the MIM elements are brought to ON condition or OFF condition, and discharge and non-discharge of the discharge liquid droplet 9 can be switched by controlling whether or not electric power is supplied to the MIM elements 1 and the heat generating resistance members 2 connected to the MIM elements 1 in series.

In the illustrated embodiment, the MIM elements 1 are formed by crossing the metal electrodes 6 on the oxidation insulation film 24 obtained by anodic oxidation of the metal electrodes 5. More specifically, the upper and lower electrodes 6, 5 shown in FIG. 4 are obtained, for example, by forming Ta film having a thickness of about 300 nm by RF spattering and oxidizing the surface of the film by anoic oxidation to provide $Ta_2O_5$ thin film having a thickness of about 32 nm. In this case, the RF spattering is performed in Ar gas environment of about $10^{-2}$ -2 Torr. Further, the anoic oxidation is performed by using mesh-shaped platinum electrode as cathode in citric acid solution of 0.8 weight/%. Further, for example, the upper electrode 6 and the information electrode 7 shown in FIG. 4 are tantalum thin film electrodes having a thickness of 23 nm, and the substrate 23 is an Si substrate having crystal axis <111> and thickness of 0.6 mm, and the insulation thin film 24 is Si thermal oxidation film having a thickness of 2.75 $\mu$m and the thin film heat generating resistance member 2 is a tantalum nitride thin film having a thickness of 0.05 $\mu$m.

Further, for example, the dimension of the heat generating resistance member 2 is 25 $\mu$m×25 $\mu$m, an area is 625 $\mu m^2$ and resistance value is 53 Ω. Further, the dimension of the MIM element 1 is 84.5 $\mu$m×20000 $\mu$m and an area is 1690000 $\mu m^2$. In this case, the area of the MIM element 1 is greater than the area of the heat generating resistance member 2 by 2704 times, and element resistance regarding voltage of 6.7 V applied between the electrodes 5 and 6 at both ends of the MIM element is 53 Ω. When voltage of 13.4 V is applied between the electrodes 5 and 7, voltage of 6.7 V is applied to the MIM element 1 and the heat generating resistance member 2, respectively, with the result that current of 126 mA flows. In this case, consumption electric power converted into heat in the MIM element 1 and the heat generating resistance member 2 is 0.847 W, and electric power density of the MIM element 1 becomes 0.5 $MW/m^3$ and electric power density of the heat generating resistance member 2 becomes 1.355 $GW/m^3$, and, in the heat generating resistance member 2, the discharge liquid is heated to generate the bubble. Further, since a heat generating amount of the MIM element 1 per unit area is 1/2704 of a heat generating amount of the heat generating resistance member 2 per unit area, increase in temperature can be suppressed.

In the illustrated embodiment, a resistance value at an operating point of the circuit in which the MIM element 1 is connected to the heat generating resistance member 2 in series is 53+53=106 Ω. If the driving voltage is increased, the resistance value of the serial circuit is limited by the resistance value of the heat generating resistance member 2, with the result that the fluctuation can be suppressed within a range from 53 to 106 Ω at the most, thereby suppressing excessive heating. Further, since the resistance value in the vicinity of the operating point is changed gently, non-discharging due to poor heat generating amount can be suppressed even when the driving voltage is decreased minutely.

Incidentally, in the illustrated embodiment, since the wiring resistance is adequately small in comparison with the resistance value of the MIM element, it is negligible.

[Second Embodiment]

Figure 7:
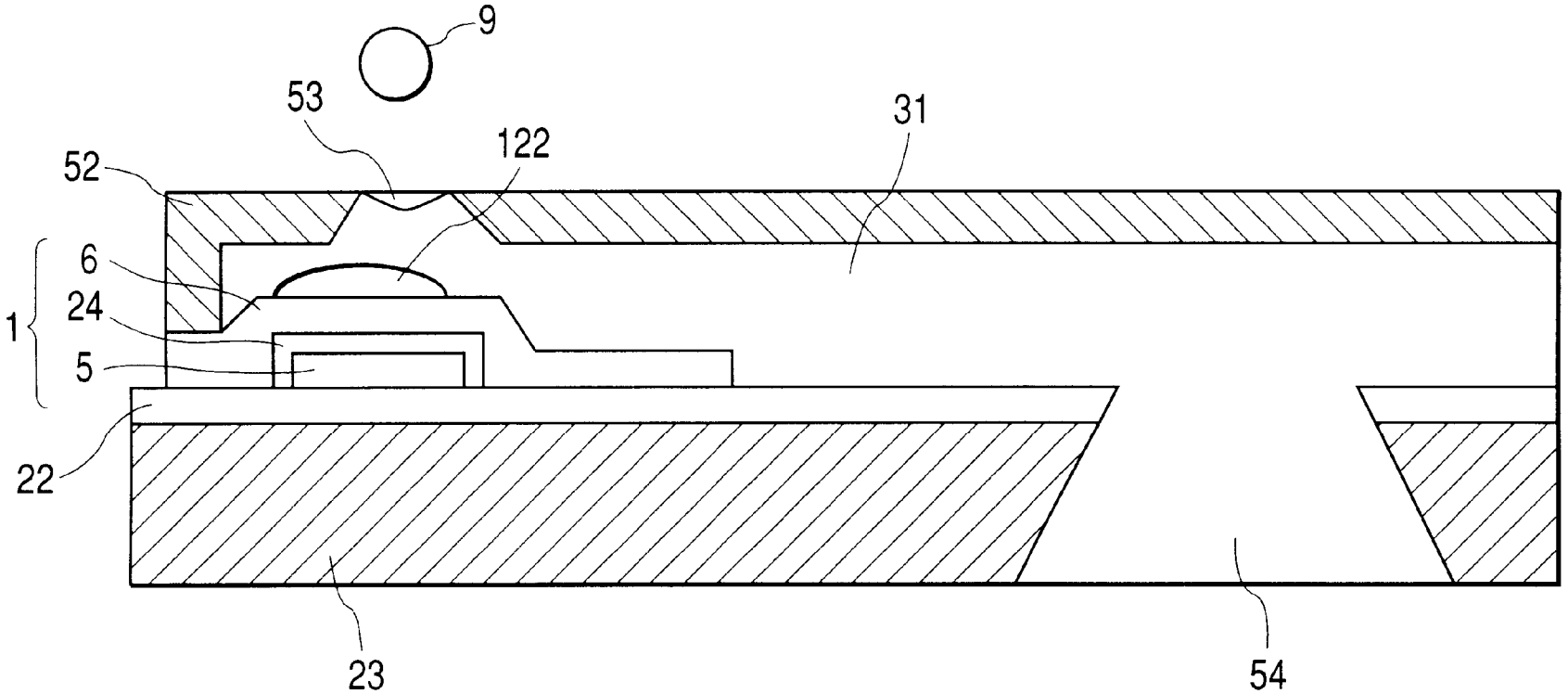
FIG. 7 is a schematic sectional view of an ink jet recording head according to a second embodiment of the present invention.

FIG. 7 is a schematic sectional view showing a construction of an ink jet recording head according to a second embodiment of the present invention. Now, with reference to FIG. 7, difference from the first embodiment will be mainly described. According to the head shown in FIG. 7, on a lower layer (insulation layer) 22 on a surface of a substrate 23, a lower electrode 5 for constituting an MIM element 1 and acting also as a scan side electrode constituting a matrix circuit is coated by a very thin insulation film 24. Further, an upper electrode 6 constituting the MIM element 1 and acting also as an information side electrode constituting the matrix circuit is coated on the insulation thin film 24.

Further, a discharge port forming member 52 having plural rows of grooves for forming flow paths 31 including one or plural MIM elements 1 contributing to the bubbling and discharge ports (for discharging recording liquid) corresponding to the flow paths 31 is joined onto the substrate 23. Further, the substrate 23 is provided with a discharge liquid supplying port 54 for simultaneously supplying the liquid to the plural flow paths 31.

Incidentally, also in this embodiment, while an example that a head structure of side shooter type is used was explained, the present invention can be applied to a so-called edge shooter type in which the discharge ports are arranged along a direction parallel to the heat generating member forming plane.

Particularly, the construction according to the illustrated embodiment includes the matrix circuit, and the MIM elements 1 disposed at junctions of the matrix circuit and contributing to the bubbling, and a resistance value of the wiring resistor connected to the MIM element 1 is selected from 0.01 to 100 times, preferably, from 0.1 to 10 times, more preferably, about 1 time of the resistance value of the MIM element 1 in the operating condition. By doing so, change in current flowing in the circuit can be suppressed, and the great change in the electrical power supplying amount of the MIM element 1 due to minute change in voltage of the power source can be suppressed. Further, in the illustrated embodiment, the resistance value of the wiring resistor is adjusted, and, since the wiring resistor also acts as adjusting resistor, increase in cost can be suppressed.

In the illustrated embodiment, the MIM element 1 is manufactured in the same manner as the first embodiment.

The dimension of the MIM element 1 is 65.08 $\mu$m×65.08 $\mu$m (square) and an area thereof is 4235 $\mu m^2$. In this case, element resistance regarding voltage of 33.5 V applied between the electrodes 5 and 6 at both ends of the MIM element is 265 Ω. Further, the resistance value of the wiring resistor is 53 Ω. When voltage of the power source is 40.2 V, voltage of 33.5 V is applied to the MIM element 1 and current of 126 mA flows. In this case, consumption electric power converted into heat in the MIM element 1 is 4.235 W, and electric power density of the MIM element 1 becomes 1 $GW/m^3$, thereby heating and bubbling the discharge liquid.

Further, in the illustrated embodiment, resistance at the operating point of the circuit is 265+53=318 Ω. If the driving voltage is increased, the resistance value of the circuit is limited by the resistance value of the wiring resistor, with the result that the fluctuation can be suppressed within a range from 53 to 318 Ω at the most, thereby suppressing excessive heating. Further, since the resistance value in the vicinity of the operating point is changed gently, non-discharging due to poor heat generating amount can be suppressed even when the driving voltage is decreased minutely.

(Ink Jet Recording Apparatus)

Figure 10:
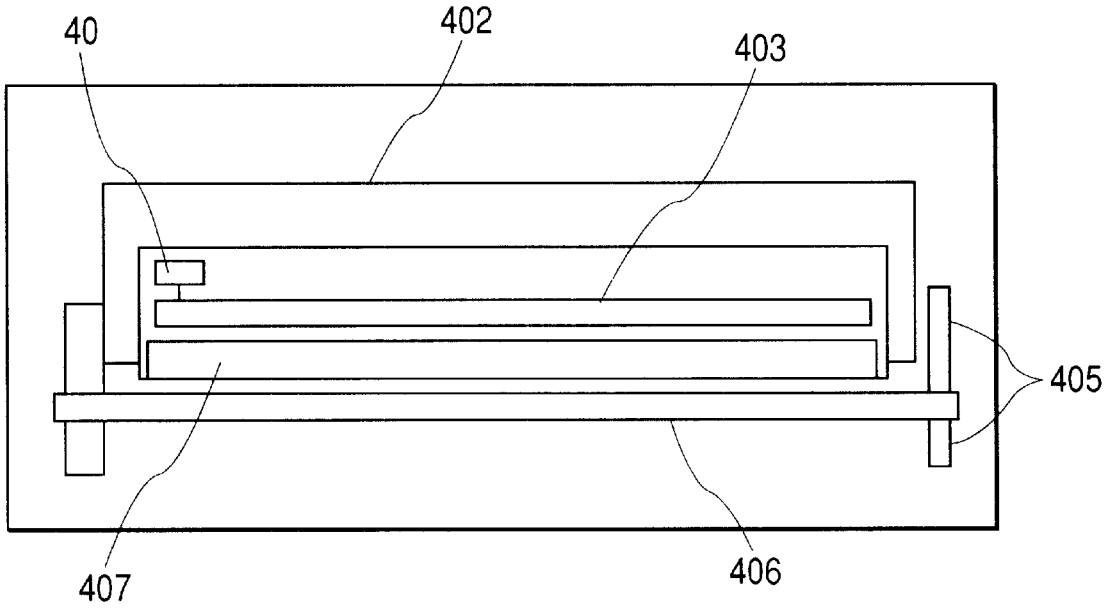
FIG. 10 is a schematic view showing an example of an ink jet recording apparatus on which the ink jet recording head according to the present invention is mounted.

FIG. 10 shows an example of an ink jet recording apparatus on which the ink jet recording head according to one of the above-mentioned embodiments is mounted.

The ink jet recording apparatus is designed to convey a paper 406 as a recording medium by a paper feeding roller 405 controlled by a driving circuit 403. Further, an ink jet recording head 407 controlled by a controller 40 is provided with discharge ports opposed to the paper 406, and discharging and non-discharging of discharge liquid droplet from the discharge port 8 are controlled by bringing the non-linear element 1 to an ON condition or an OFF condition in response to a signal from the controller 40. When the ink on the heat generating resistance member 2 to which the electric power is supplied in this way is heated quickly, the bubble is generated with very high pressure on the entire surface of the heat generating means (non-linear element 1 or heat generating resistance member 2) by the film-boiling phenomenon. By such pressure, as mentioned above, the discharge liquid droplet 9 is discharged from the discharge port 8, thereby forming an image on the recording medium. Further, as the discharge liquid droplet 9 is discharged, the ink is supplied to the ink jet recording head from an ink tank 402.

What is claimed is:

1. An ink jet recording head comprising:

a non-linear element having a non-linear current/voltage property and capable of passing a current for generating thermal energy in a heat generating portion to be utilized to discharge ink; and current adjusting means for adjusting the current flowing into said non-linear element, wherein said current adjusting means comprises a current adjusting resistor connected to said non-linear element in series, and a resistance value of said current adjusting resistor is from 0.1 to 10 times a resistance value of said non-linear element in an operating condition.

2. An ink jet recording head according to claim 1, wherein said non-linear element is a non-linear element having MIM type electrical characteristics.

3. An ink jet recording head according to claim 1, wherein said heat generating portion is provided in said non-linear element.

4. An ink jet recording head according to claim 1, further comprising matrix electrodes constituting a matrix circuit for applying voltage to said non-linear element.

5. An ink jet recording head according to claim 4, wherein said non-linear element is disposed at a junction of said matrix circuit.

6. An ink jet recording head according to claim 1, wherein said ink jet recording head is designed to discharge the ink by causing film-boiling in the ink by the thermal energy.

7. An ink jet recording apparatus comprising:

an ink jet recording head according to claim 1; and conveying means for conveying a recording medium, wherein said ink jet recording head has a discharge port provided in correspondence to said heat generating portion and adapted to discharge the ink toward a recording surface of the recording medium.

8. An ink jet recording head comprising:

a non-linear element capable of passing a current for generating thermal energy in a heat generating portion to be utilized to discharge ink; and a wiring for energizing said non-linear element, wherein resistance of said wiring is used as a current adjusting resistor for adjusting current flowing in a circuit including said non-linear element and said wiring, and a resistance value of said wiring resistance is from 0.1 to 10 times a resistance value of said non-linear element in an operating condition.

9. An ink jet recording head according to claim 8, wherein said non-linear element is a non-linear element having MIM type electrical characteristics.

10. An ink jet recording head according to claim 8, wherein said heat generating portion is provided in said non-linear element.

11. An ink jet recording head according to claim 8, further comprising matrix electrodes constituting a matrix circuit for applying voltage to said non-linear element.

12. An ink jet recording head according to claim 11, wherein said non-linear element is disposed at a junction of said matrix circuit.

13. An ink jet recording head according to claim 8, wherein said ink jet recording head is designed to discharge the ink by causing film-boiling in the ink by the thermal energy.

14. An ink jet recording apparatus comprising:

an ink jet recording head according to claim 8; and conveying means for conveying a recording medium, wherein said ink jet recording head has a discharge port provided in correspondence to said heat generating portion and adapted to discharge the ink toward a recording surface of the recording medium.

15. An ink jet recording head comprising:

a non-linear element having a non-linear current/voltage property and capable of passing a current for generating thermal energy in a heat generating portion to be utilized to discharge ink; and matrix electrodes constituting a matrix circuit for applying voltage to said non-linear element, wherein said non-linear element is disposed at a junction of said matrix circuit and a current/voltage property at said junction is such that differential resistance at a driving voltage is 40 to 250 Ω.

16. An ink jet recording head comprising:

a non-linear element having a non-linear current/voltage property and capable of passing a current for generating thermal energy in a heat generating portion to be utilized to discharge ink; and matrix electrodes constituting a matrix circuit for applying voltage to said non-linear element, wherein said non-linear element is disposed at a junction of said matrix circuit and a current/voltage property at said junction is such that an effective current starts to flow at said junction from the time that a voltage at said junction reaches a value of about ½ of an operating voltage and a desired current flows at the operating voltage.

17. An ink jet recording head comprising:

a non-linear element having a non-linear current/voltage property and capable of passing a current for generating thermal energy in a heat generating portion to be utilized to discharge ink; and matrix electrodes constituting a matrix circuit for applying voltage to said non-linear element, wherein said non-linear element is disposed at a junction of said matrix circuit and a current/voltage property at said junction is such that an effective current starts to flow at said junction from the time that a voltage at said junction reaches a value of about ⅓ of an operating voltage and a desired current flows at the operating voltage.

18. An ink jet recording head according to claim 1, wherein the resistance value of said current adjusting resistor is about 1 time or about 2 times the resistance value of said non-linear element in the operating condition.

19. An ink jet recording head according to claim 8, wherein the resistance value of said wiring resistance is about 1 time or about 2 times the resistance value of said non-linear element in the operating condition.

* * * * *